United States Patent [19]

Nagasawa

[11] 4,116,188

[45] Sep. 26, 1978

[54] CAPACITOR DISCHARGE TYPE CONTACTLESS IGNITION SYSTEM FOR INTERNAL COMBUSTION ENGINES

[75] Inventor: Masao Nagasawa, Kariya, Japan

[73] Assignee: Nippondenso Co., Ltd., Kariya, Japan

[21] Appl. No.: 745,645

[22] Filed: Nov. 29, 1976

Related U.S. Application Data

[62] Division of Ser. No. 515,247, Oct. 16, 1974, Pat. No. 4,014,309.

[30] Foreign Application Priority Data

Oct. 17, 1973 [JP] Japan ..... 48/117120

[51] Int. Cl.[2] ..... F02P 1/00

[52] U.S. Cl. ..... 123/148 CC; 123/148 S

[58] Field of Search ..... 123/148 CC, 148 E, 148 S

[56] References Cited

U.S. PATENT DOCUMENTS

| | | | |
|---|---|---|---|
| 3,903,862 | 9/1975 | Nagasawa | 123/148 CC |
| 3,911,886 | 10/1975 | Nagasawa | 123/148 CC |
| 3,911,889 | 10/1975 | Nagasawa | 123/148 CC |
| 4,014,309 | 3/1977 | Nagasawa | 123/148 CC |

*Primary Examiner*—Ronald B. Cox

*Attorney, Agent, or Firm*—Cushman, Darby & Cushman

[57] ABSTRACT

In the ignition system having a thyristor for performing a switching action, another thyristor is connected to capacitor charging coils in parallel with the thyristor, a primary winding of a transformer is connected in series with the another thyristor, a secondary winding is connected to a gate of the thyristor, and a trigger coil generating an ignition signal and a reversion protecting signal is connected to a gate of the another thyristor. By the transformer and the another thyristor, only the ignition signal is applied to the gate of the thyristor during a normal running of an engine, while only the reversion protecting signal is applied to the gate of the thyristor during a reverse rotation of the engine to prevent a capacitor from being charged thus protecting the reverse rotation.

6 Claims, 17 Drawing Figures

CAPACITOR DISCHARGE TYPE CONTACTLESS IGNITION SYSTEM FOR INTERNAL COMBUSTION ENGINES

RELATED APPLICATION

This application is a division of my copending application Ser. No. 515,247, filed Oct. 16, 1974 and now U.S. Pat. No. 4,014,309.

BACKGROUND OF THE INVENTION

The present invention relates to an ignition system, especially to a contactless capacitor discharge type ignition system for an internal combustion engine, in which a magneto generator is employed as an electric power source for charging a capacitor provided therein, and more especially to an ignition system which prevents particularly a two-cycle engine from being continued to rotate in a reverse direction.

In a conventional ignition system of this kind, it is known that continuation of reverse rotation of an engine is prevented by making the system not to supply an ignition signal to a control gate of a switching element such as a thyristor, however when the engine is forced to rotate in the reverse direction at a high speed due to some accidental reasons the capacitor is to be charged by higher voltage produced at the magneto generator, and thereby such electric elements as the capacitor, thyristor, a diode or the like may be broken because of such high voltage.

SUMMARY OF THE INVENTION

It is, therefore, a primary object of the present invention to overcome the drawbacks mentioned above, and for this purpose when the engine is rotated in the reverse direction by accident the voltage produced at the magneto generator is bypassed so as not to charge the capacitor.

Another object of the present invention is to provide an ignition system in which during a reverse rotation of an engine an ignition spark may be carried out at an instant other than an ignition timing, for example at the instant where a piston of the engine is positioned at a bottom dead center, whereby the continuation of the reverse rotation can be prevented and further a capacitor or the like is prevented from overcharge.

A further object of the present invention is to provide an ignition system which can prevent the engine from continuing to rotate in the reverse direction.

A further object of the present invention is to provide an ignition system, in which the capacitor is charged with more than two half-waves of an alternating current produced at the magneto generator, thereby to obtain higher ignition energy at a spark plug.

These together with other objects and advantages which will become subsequently apparent reside in the details of construction and operation as more fully hereinafter described and claimed, reference being had to the accompanying drawings forming a part thereof.

DESCRIPTION OF THE PREFERRED EMBODIMENTS

Figure 1:
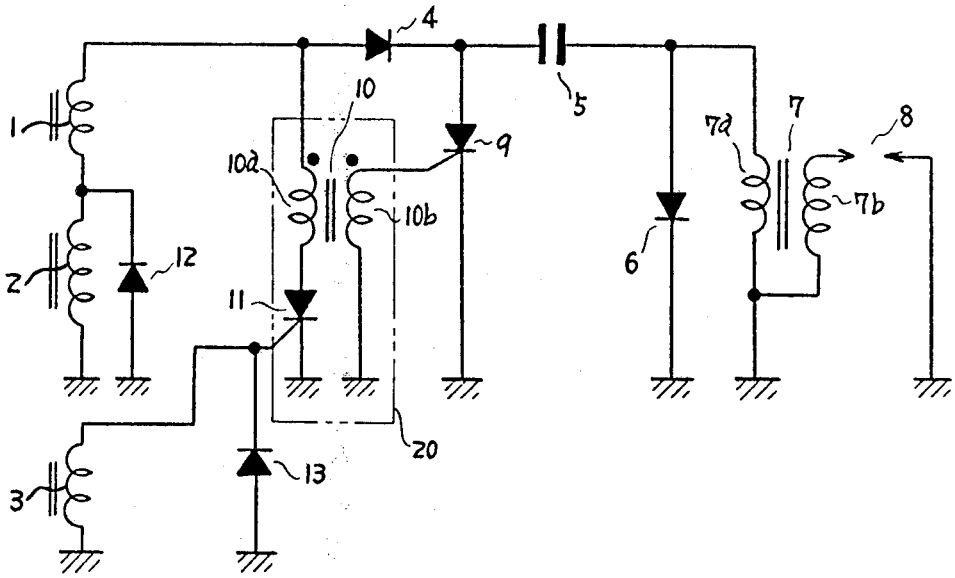
FIGS. 1, 4, 5, 6, 8, 9, 10, 11, 12, 13, 14, 15 and 16 are respectively a first to thirteenth embodiment of the present invention.

Now referring to FIG. 1 showing the first embodiment of the present invention, capacitor charging coils 1 and 2 are mounted in a magneto generator (whose construction is described hereinafter in detail) fixed to an internal combustion engine for producing alternating current in synchronism with the rotation thereof. The number of turns of the coil 1 is lower than that of the coil 2. A trigger coil 3 generates an ignition signal as well as a reversion protecting signal. A diode 4 for rectifying the alternating current produced at the capacitor charging coils 1 and 2, a capacitor 5 for charging the rectified current and a primary winding 7*a* of an ignition coil 7 are connected in series. The ignition coil 7 also has a secondary winding 7*b* connected to a spark plug 8. A diode 6 is connected in parallel with the primary winding 7*a* for extending an arc duration of an ignition spark at the spark plug 8. A thyristor 9 has a control gate connected to a thyristor control means 20. The thyristor control means 20 consists of a transformer 10 whose primary winding 10*a* is connected in parallel with the coils 1 and 2, and whose secondary winding 10*b* is connected to the control gate of the thyristor 9, and another thyristor 11 connected in series with the primary winding 10*a*. A control gate of the another thyristor 11 is connected to the trigger coil 3 in parallel with a diode 13.

Figure 3A:
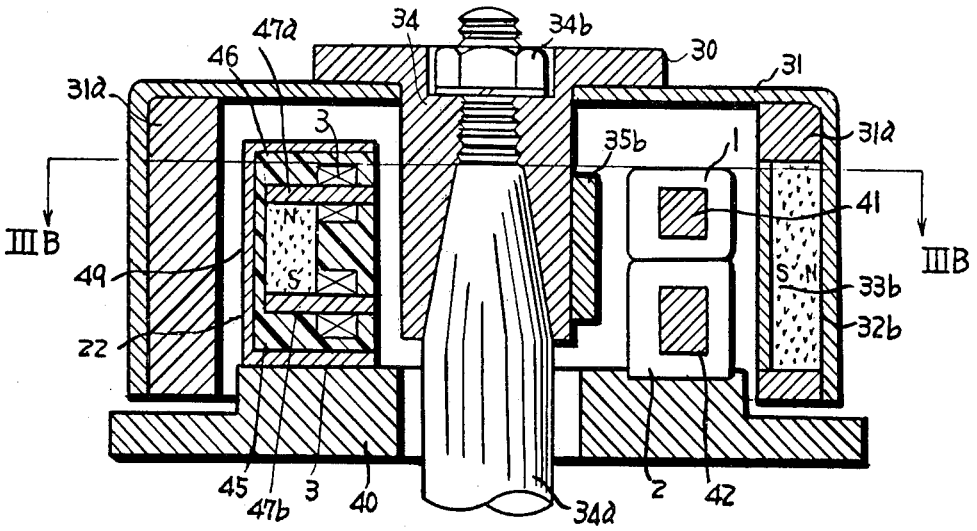
FIGS. 3(A) and 3(B) are respectively a longitudinal sectional view of a magneto generator employed in the present invention, being taken along the line IIIA—IIIA in FIG. 3(B), and a transverse sectional view taken along the line IIIB—IIIB in FIG. 3(A).
Figure 3B:
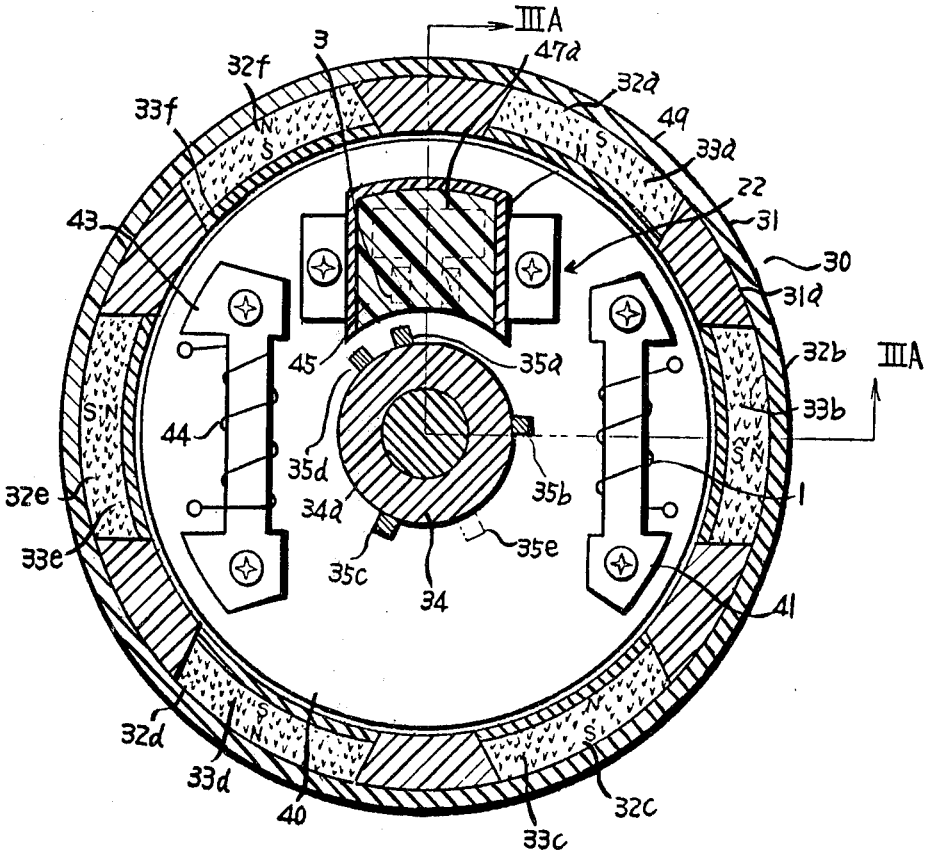

A construction of a magneto generator, which may be employed in the present invention, of an outer revolving six-pole type will be described with references in FIGS. 3(A) and 3(B), in which a rotor 30 comprises an iron shell 31, six permanent magnets 32*a* to 32*f* spaced at equal intervals and securely embedded in the inner side of the iron shell 31 by means of a nonmagnetic material 31*a* such as aluminum or resin, six pole pieces 33*a* to 33*f* secured respectively to the inner face of the permanent magnets 32*a* to 32*f*, a center piece 34 securely mounted on a crankshaft 34*a* of the engine by a nut 34*b* and securely fixing the iron shell 31 by means of rivets which are not shown, and timing cores 35*a* to 35*d* secured to the center piece 34.

A stator 40 is secured to the engine, on which capacitor charging cores 41 and 42 are placed one upon another. The capacitor charging coils 1 and 2 are wound respectively on the cores 41 and 42. A lamp load core 43 is securely mounted on the stator 40 at a position displaced by about 180°, i.e., opposite to the capacitor charging cores 41 and 42, with a lamp load power supply coil 44 constituting a power supply for a load such as lamps.

A stator 22 of a timing signal generator is securely mounted on the stator 40 at a position displaced by about 90° from the capacitor charging cores 41 and 42, and comprises, a permanent magnet 46, cores 47*a* and 47*b* disposed on the opposite sides of the magnet 46, the trigger coil 3 wound respectively on the cores 47*a* and 47*b*, a case 49 in which these elements are housed and a sealing resin 45 filed in the case 49.

Figure 2:
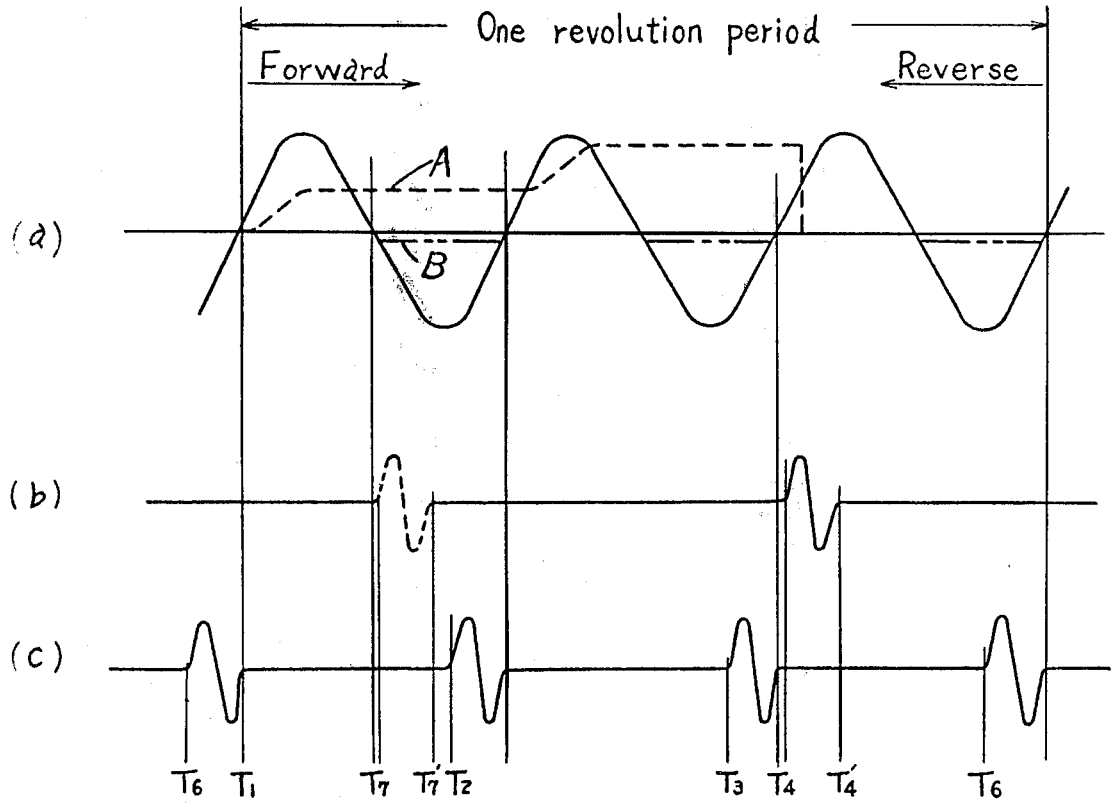
FIGS. 2 and 7 are waveform diagrams showing operation of the above respective embodiments.

With the magneto generator constructed as above described, for each revolution of the magneto generator, i.e., for each rotation of the engine crankshaft 34*a*, the capacitor charging coils 1 and 2 generate three cycles of the AC no-load voltage as shown in FIG. 2(*a*), while for each rotation of the crankshaft 34*a*, the timing generator, namely the trigger coil 3, generates an ignition signal as shown in FIG. 2(*b*) by a solid line as well as the reversion protecting signals as shown in FIG. 2(*c*). The ignition signal is generated when the output voltage of the coils 1 and 2 is positive and the reversion protecting signals are generated just before the output voltage of the coils 1 and 2 changes from the negative to the positive direction.

The operation of the first embodiment constructed as described above will now be explained. The operation of the various parts of the embodiment which take place along with the rotation of the engine will be explained. The capacitor 5 is going to be charged from a time T1 with the positive half waves produced at the capacitor charging coils 1 and 2 as indicated by a broken line in FIG. 2(*a*). Here, when the engine rotates at a low speed, the capacitor charging coil 2 having a relative large number of winding turns mainly serves to charge the capacitor 5, while the coil 1 mainly serves to charge the capacitor 5 at a high speed of the engine through the diode 12. And at a time T4 when the trigger coil 3 generates an ignition signal, the another thyristor 11 is driven into conduction due to the positive electric potential at the anode of the thyristor 11, the transformer 10 then generates an output voltage to supply it to the gate of the thyristor 9, and the thyristor 9 is made conductive, whereby the charge stored in the capacitor 5 is discharged through the thyristor 9, the ground and the primary winding 7*a* of the ignition coil 7 to induce a high voltage at the secondary winding 7*b*, thus producing an ignition spark at the spark plug 8. The trigger coil 3, of course, generates the reversion protecting signals at times T2, T3 and T6 as shown in FIG. 2(*c*), however the thyristor 11 can not be made conductive due to the negative electric potential at the anode thereof at those times, whereby the thyristor 9 is not effected. Accordingly the capacitor 5 is charged with a plurality of positive half waves from the time T1 to T4 as shown by dash line A in FIG. 2(*a*) without any influences of the reversion protecting signals. Repeating the above described operation, the ignition spark is produced for each revolution of the magneto generator.

On the other hand, when the engine is forced to rotate in the reverse direction by accident, the polarity of the generated voltages of the capacitor charging coils 1 and 2 and the trigger coil 3 is changed to the opposite. The operation in the reverse rotation of the engine will be described with reference in FIG. 2. The reversion protecting signals at the trigger coil 3 are generated just after every positive half wave is generated at the capacitor charging coils 1 and 2 contrary to the normal running of the engine. Because of the positive half wave at the capacitor charging coils 1 and 2 when the reversion protecting signals are generated at the trigger coil 3, the another thyristor 11 is made conductive as soon as every positive half-wave is generated. Accordingly the thyristor 9 is made conductive because of the output at the secondary winding 10*b* of the transformer 10, whereby every positive half wave at the capacitor charging coils 1 and 2 is grounded through the thyristor 9, thus preventing the capacitor 5 from being charged. Consequently the ignition spark is not produced and the reverse rotation of the engine is prevented from being continued.

The ignition signal at the time T4′ has no influence on the thyristor 9 during the reverse rotation of the engine, since the electric potential at the anode thereof is negative at the time T4′ when the ignition signal is generated.

Generally speaking, as a thyristor having a large capacity operates with low sensitivity corresponding to the amount of the capacity, a trigger coil for controlling such a thyristor must be designed larger in order to perform a well operation during the low speed of the engine. However, according to the present invention, the trigger coil 3 is connected to the thyristor 9 having the large capacitor through the transformer 10 to which the another thyristor having a relatively small capacity is connected, whereby the trigger coil 3 need not to be designed larger in order to operate the another thyristor 11 with high sensitivity and further the thyristor 9 operates well because of a signal, at its control gate, amplified by the transformer 10.

In the above explained embodiment, the capacitor is prevented from being charged during the reverse rotation of the engine in order to prevent the reverse rotation, however another modification for protecting the reverse rotation will be described with references in FIGS. 1 and 2. According to the modification, the reversion protecting signals generated at the times T2, T3 and T6 are not necessary, however instead of those the trigger coil 3 is so designed to generate a reverse ignition signal at a time T7 as indicated by a broken line in FIG. 2(*b*) as well as the ignition signal at the time T4. The reverse ignition signal has no influence on the operation of this ignition system during the normal running of the engine, because the another thyristor 11 can not be made conductive due to the negative electrical potential at the anode thereof at the time T7. However when the engine is forced to rotate in the reverse direction by accident, the reverse ignition signal makes the thyristor 9 conductive, thereby to produce an ignition spark at the time T7′, for the ignition signal at the time T4′ has no influence on the thyristor 9 during the reverse rotation of the engine as explained in the above embodiment. The time T7′ approximately corresponds to a bottom dead center of the engine, and therefore the engine can not obtain enough power to continue to rotate in the reverse direction.

The construction of the magneto generator for this modification is completed by taking away the timing cores 35*b*, 35*c* and 35*d* and providing a core 35*e* on the center piece 34 in FIG. 3 so as to obtain the reverse ignition signal.

Figure 4:
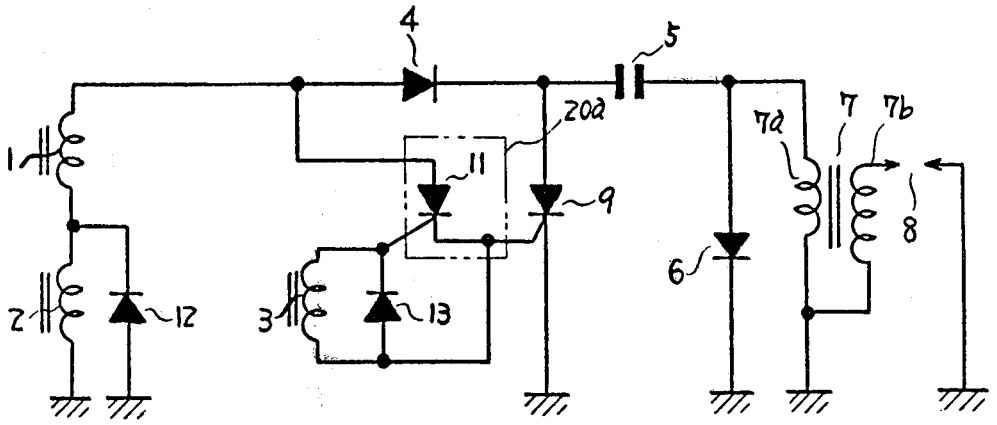

Referring next to FIG. 4 showing the second embodiment of the present invention, the thyristor control means 20 in FIG. 1 is replaced with a thyristor control means 20*a* in this embodiment by eliminating the transformer 10, and the operation of this embodiment is almost same as that of the first embodiment, whereby it is omitted.

Figure 5:
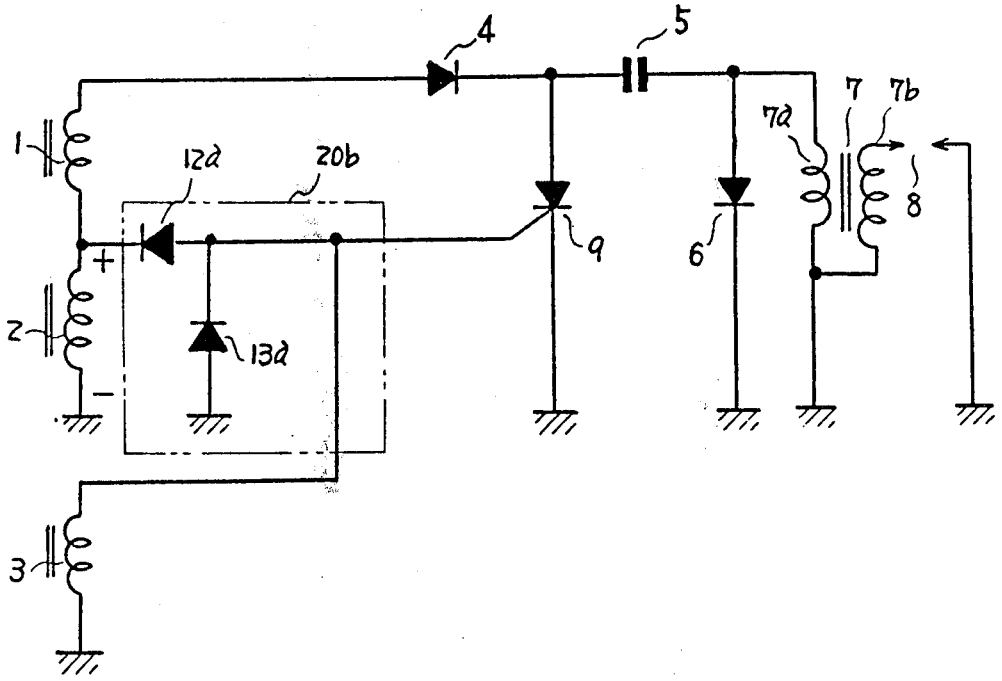

Referring to FIG. 5 showing the third embodiment, a thyristor control means 20*b* is consisting of diodes 12*a* and 13*a*, the cathode of the diode 12*a* being connected to a junction point of the capacitor charging coils 1 and 2.

The operation of the third embodiment will be described with reference to FIG. 2. When the ignition signal is generated at the trigger coil 3 at the time T4 during the normal running of the engine, the polarity of the output voltage at the coil 2 is so designated in FIG. 5, that is the electric potential at the junction point is positive and the negative at the grounded terminal of the coil 2. Therefore the ignition signal generated at the trigger coil 3 is supplied to the gate of the thyristor 9 to make it conductive to produce the ignition spark.

And when the reversion protecting signals are generated at the trigger coil 3 at the times T2, T3 and T6 in FIG. 2 during the normal running of the engine, the polarity of the generated voltage at the capacitor charging coil 2 is reversed, that is the potential at the junction point is negative and the potential at the grounded terminal of the coil is positive. Therefore these signals are not supplied to the gate of the thyristor 9 but bypassed to the ground through the diode 12*a* and the coil 2. Accordingly the positive half waves produced at the capacitor charging coils 1 and 2 are charged in the capacitor 5.

However when these reversion protecting signals are generated during the reverse rotation of the engine, the potential at the junction point of the capacitor charging coils 1 and 2 is positive and the potential at the grounded terminal thereof is negative. Therefore these signals are applied to the gate of the thyristor 9 to make it conductive, whereby the positive halfwaves produced at the capacitor charging coils 1 and 2 are always bypassed to the ground through the thyristor 9 not to charge the capacitor 5, thus preventing the engine from firing and further preventing break down of the capacitor or the like from high voltage.

Figure 6:
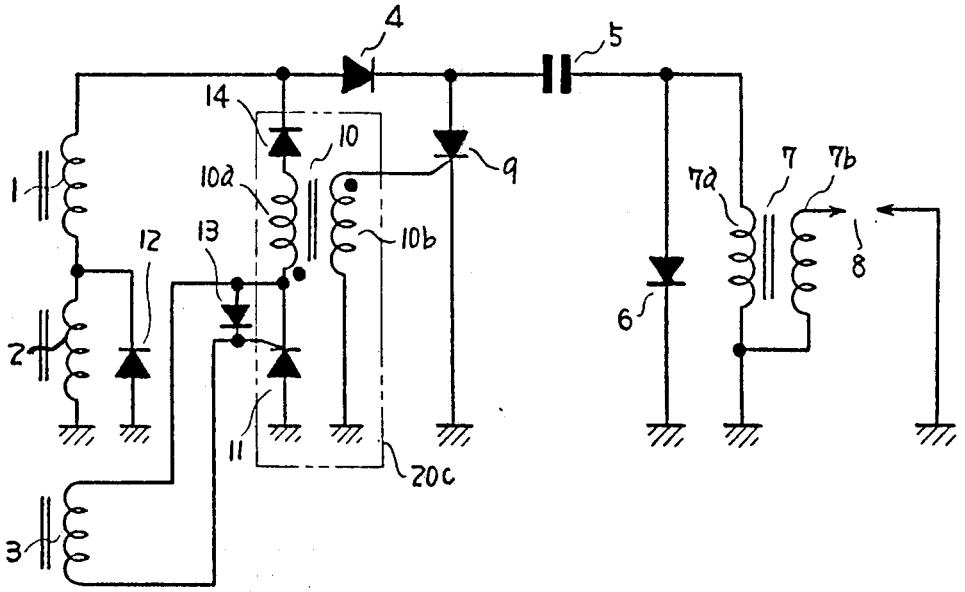

FIG. 6 shows a fourth embodiment of the present invention, in which a transformer 10 consists of differential windings 10*a* and 10*b*, and other parts are almost same as that in FIG. 1.

Figure 7:
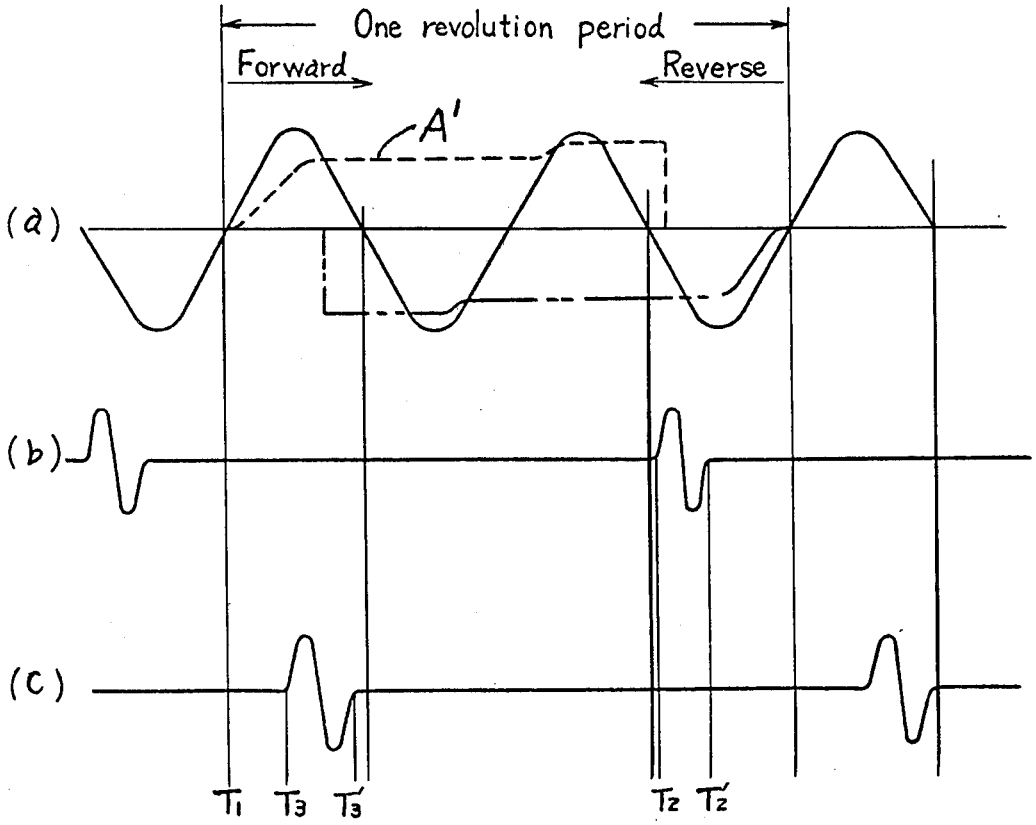

The operation of the fourth embodiment will be described with references in FIG. 7, employing a four pole magneto generator. When the output voltage of the capacitor charging coils 1 and 2 begins to increase in the positive direction at a time T1 in FIG. 7(*a*), in which the output voltage is indicated by a solid line, electric current flows through the capacitor charging coils 2 and 1, the diode 4, the capacitor 5, the parallel circuit of the diode 6 and the primary winding 7*a* of the ignition coil 7 and the ground in order to charge the capacitor 5 as indicated by a dotted line in FIG. 7(*a*). The capacitor 5 is charged by the current having the two positive half-waves. When the output voltage of the capacitor charging coils 1 and 2 begins to increase in the negative direction at a time T2, a timing signal is generated at the trigger coil 3 as shown in FIG. 7(*b*) to make the thyristor 11 conductive. Though at a time T3 earlier than the time T2 a reversion protecting signal is generated at the trigger coil 3 as shown in FIG. 7(*c*), the thyristor 11 can not be made conductive since at that time the negative potential is applied to the anode of the thyristor 11. On the contrary since at the time T2 the positive potential is applied to the anode of the thyristor 11 and the negative potential is applied to the cathode thereof, the thyristor 11 is made conductive, whereby electric current flows through the capacitor charging coils 1 and 2, the ground, the thyristor 11, the primary winding 10*a* of the transformer 10 and the diode, thus producing an ignition signal at the secondary winding 10*b* of the transformer 10. Then the thyristor 9 is made conductive due to the ignition signal as its gate, the charge stored in the capacitor 5 is discharged through the thyristor 9, the ground and the primary winding 7*a* of the ignition coil 7 to induce a high voltage at the secondary winding 7*b* of the ignition coil 7, thereby to produce an ignition spark at the spark plug 8.

If the engine is forced to rotate in the reverse direction by accident, the polarity of the output voltage of the capacitor charging coils 1 and 2 is reversed. And when the ignition signal is generated at the trigger coil 3 at a time T2′ the thyristor 11 is not made conductive since the negative potential is applied to the anode thereof. On the contrary at a time T3′ the thyristor 11 is made conductive since the positive potential is applied to the anode thereof. Then an ignition spark is produced at the spark plug 8 at the time T3′, however the time T3′ is approximately equivalent to a bottom dead center judging from the position of the piston corresponding to that time. Therefore the reverse rotation of the engine can not be continued.

Figure 8:
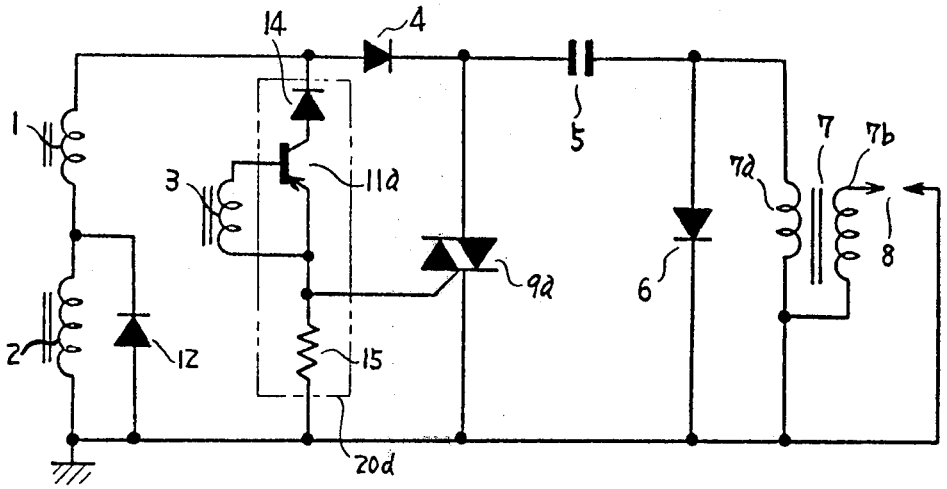

FIG. 8 shows a fifth embodiment of the present invention, in which a bidirectional thyristor 9*a* is employed instead of the thyristor 9 in comparison with the fourth embodiment shown in FIG. 6, and further a thyristor control means 20*d* consists of a transistor 11*a*, a resistor 15 and a diode 14 instead of the transformer 10 in FIG. 6. The other construction is almost same as that shown in FIG. 6.

The operation of this embodiment will be described with references in FIG. 7. The trigger coil 3 generates the reversion protecting signal at the time T3 as well as the ignition signal at the time T2. And the thyristor control means 20*d* generates a signal to supply it to the gate of the thyristor 9*a* only when the negative halfwave is generated at the coils 1 and 2 and the trigger coil 3 generates either the ignition signal or the reversion protecting signal. Accordingly the thyristor 9*a* is supplied with the signal at its gate only at the time T3 to produce the ignition spark during the normal running of the engine, and further supplied with the signal only at the time T2′ during the reverse rotation. Then the reverse rotation of the engine will be prevented from being continued in the same manner described in the fourth embodiment in FIG. 6.

Figure 9:
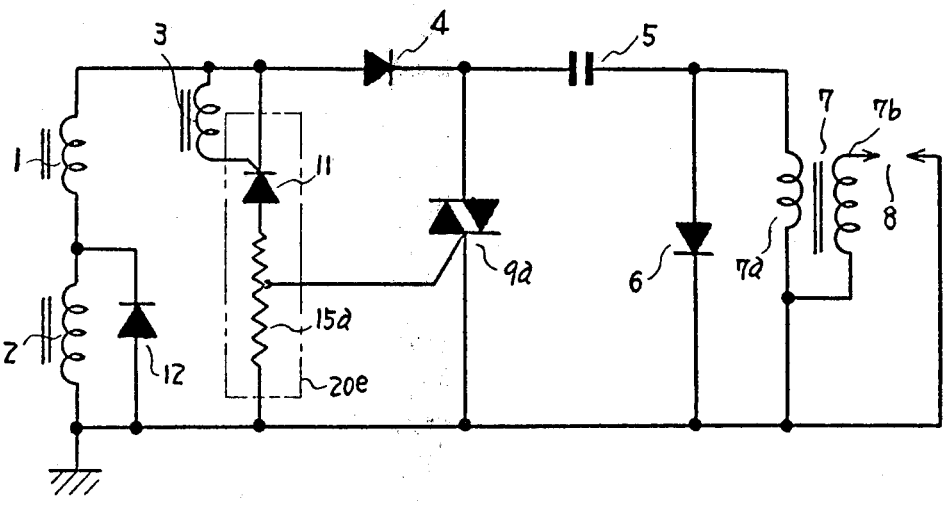

FIG. 9 shows a sixth embodiment of the present invention, in which the thyristor control means 20*e* consists of an auxiliary thyristor 11 and a voltage dividing resistor 15*a* replacing each element in the thyristor control means 20*d* in FIG. 8. The operation of this sixth embodiment is almost same as that described in FIG. 8, and thereby it is omitted.

Figure 10:
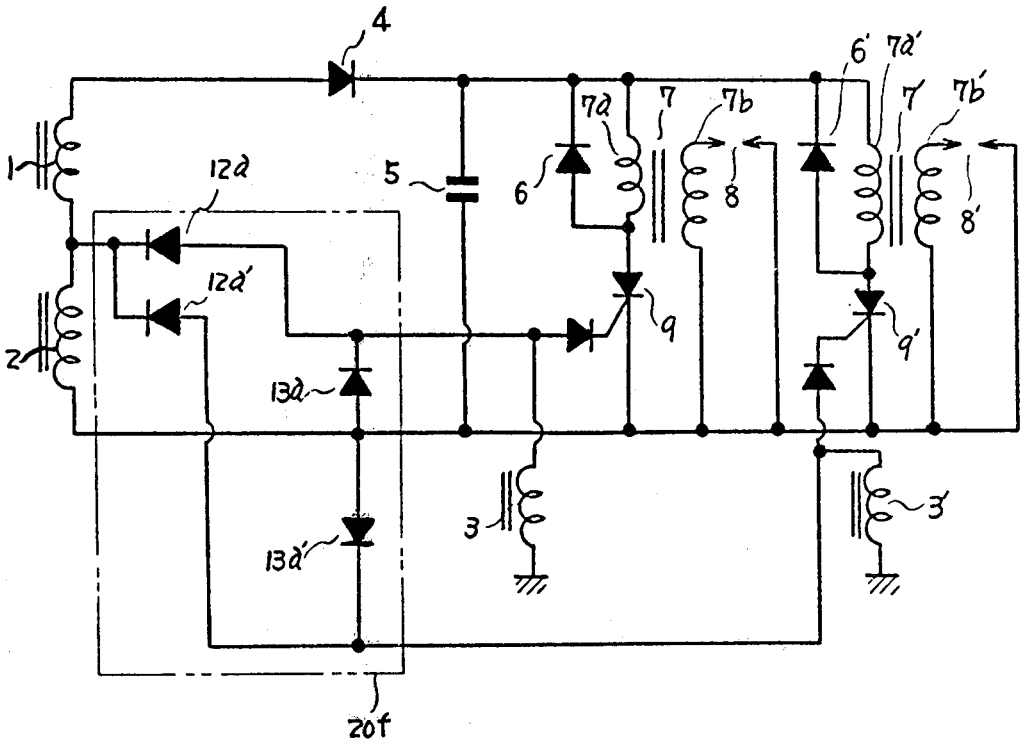

FIG. 10 shows a seventh embodiment of the present invention, which is designed for a two cylinder engine with a four-pole magneto generator by arranging the third embodiment shown in FIG. 5. Numeral 3′ designates a trigger coil, 6′, 12*a*′ and 13*a*′ diodes, 7′ an ignition coil having a primary winding 7*a*′ and a secondary winding 7*b*′, 8′ a spark plug and 9′ a thyristor. A thyristor control means 20*f* consists of the diodes 12*a*, 12*a*′, 13*a* and 13*a*′. When the trigger coils 3 and 3′ produce alternatively timing signals having an interval of 180°, the thyristors 9 and 9′ are alternatively driven into conduction in accordance with the timing signals at the trigger coils 3 and 3′.

Figure 11:
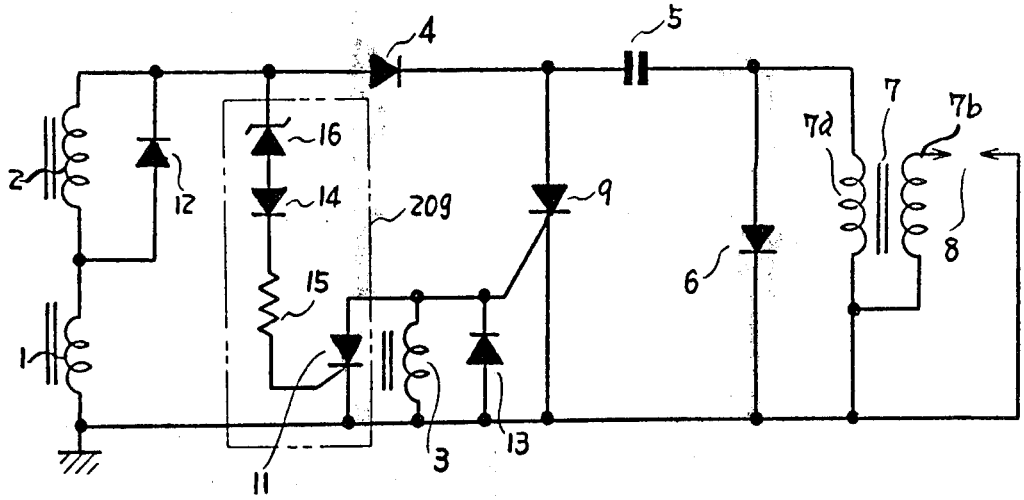

FIG. 11 shows an eighth embodiment of the present invention. A thyristor control means 20*g* consists of a diode 14, a resistor 15, a zener diode 16 and an auxiliary thyristor 11, and the trigger coil 3 is connected to the anode of the auxiliary thyristor 11 as well as the gate of the thyristor 9.

The operation of the eighth embodiment will be described with reference to FIG. 7. The trigger coil 3 generates the ignition signal at the time T2 as well as the reversion protecting signal at the time T3, however only the ignition signal is supplied to the gate of the thyristor 9 during the normal running the engine, since the reversion protecting signal is bypassed through the auxiliary thyristor 11 because of conduction thereof at the time T3.

Contrary to that, only the reversion protecting signal is supplied to the gate of the thyristor during the reverse rotation of the engine, whereby the reverse rotation of the engine can be prevented from being continued as in the same manner described above.

Figure 12:
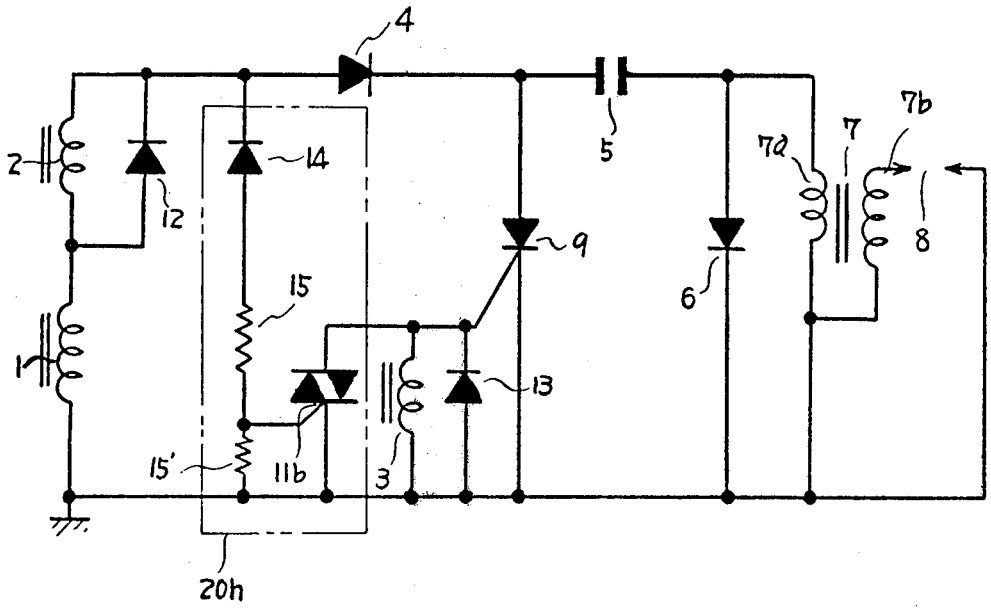

FIG. 12 shows a ninth embodiment of the present invention. Difference with regard to FIG. 11 resides in that the thyristor control means 20*h* consists of a bidirectional thyristor 11*b*, resistors 15 and 15' and a diode 14.

The operation of the ninth embodiment shown in FIG. 12 will be described with reference to FIG. 2. The trigger coil 3 generates the reversion protecting signal at the time T7 as well as the ignition signal at the time T4. Since the bidirectional thyristor 11*b* is made conductive when the negative half-wave is generated at the coils 1 and 2, for example at the time T7, the reversion protecting signal produced at the trigger coil 3 is bypassed through the bidirectional thyristor 11*b*. Accordingly the capacitor 5 is charged with two positive half-waves as shown in FIG. 2(*a*), and the charge stored in the capacitor 5 is discharged at the time T4 to produce the ignition spark. When the engine is forced to rotate in the reverse direction the polarity of the output voltage at the coils 1 and 2 is reversed, whereby only the reversion protecting signal is supplied to the thyristor 9 to produce the ignition spark at instant where the piston is positioned around the bottom dead center, thus preventing the reverse rotation of the engine and further electric compononets from high voltage.

Figure 13:
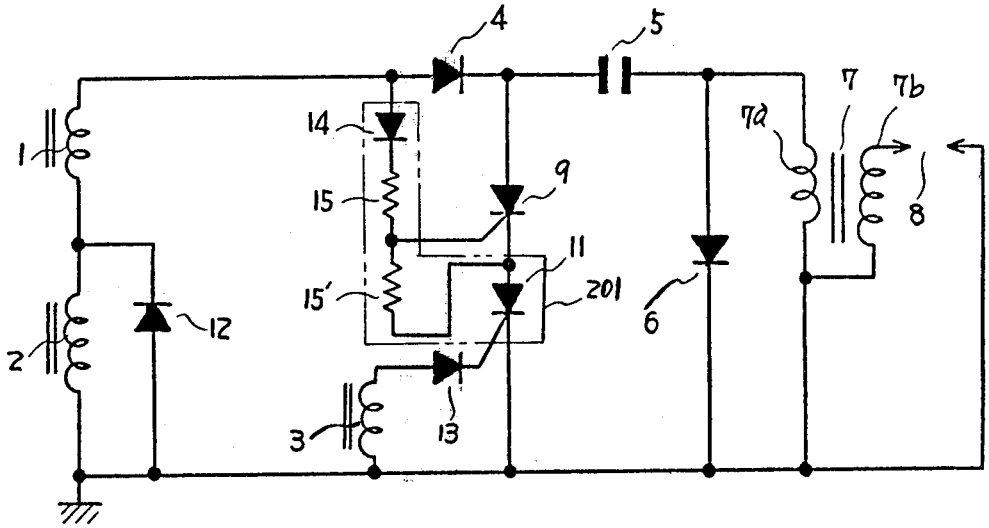

FIG. 13 shows a tenth further embodiment of the present invention, in which the difference with regard to the ninth embodiment shown in FIG. 12 resides in that the thyristor control means 20*i* consists of a diode 14, resistors 15 and 15' and another thyristor 11. The other construction and the operation are substantially same as that of FIG. 12.

Figure 14:
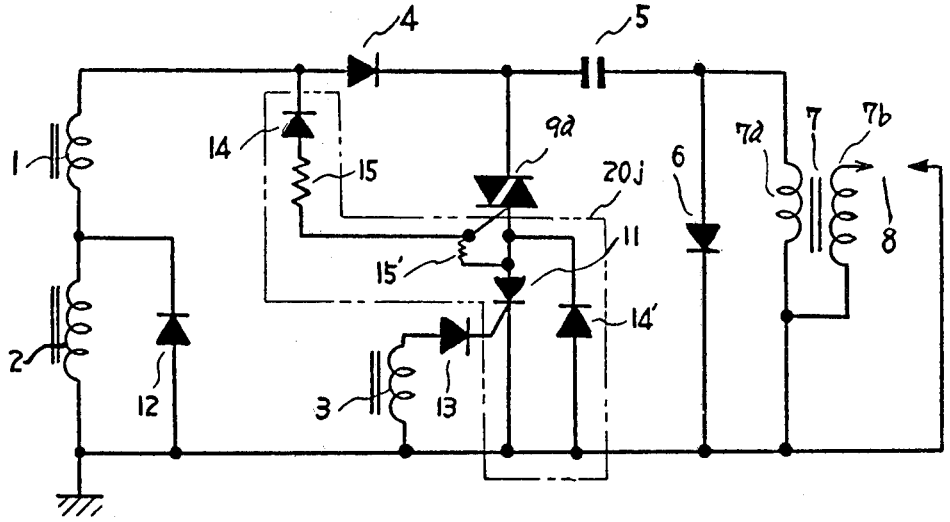

FIG. 14 shows an eleventh embodiment of the present invention in which the thyristor 9 is replaced by the bidirectional thyristor 9*a* and the thyristor control means 20*j* is provided between the bidirectional thyristor 9*a* and the trigger coil 3. The thyristor control means 20*j* consists of diodes 14 and 14', the resistors 15 and 15' connected in series with each other and another thyristor connected in parallel with the diode 14'. The other construction and the operation are substantially same as that of FIG. 6.

Figure 15:
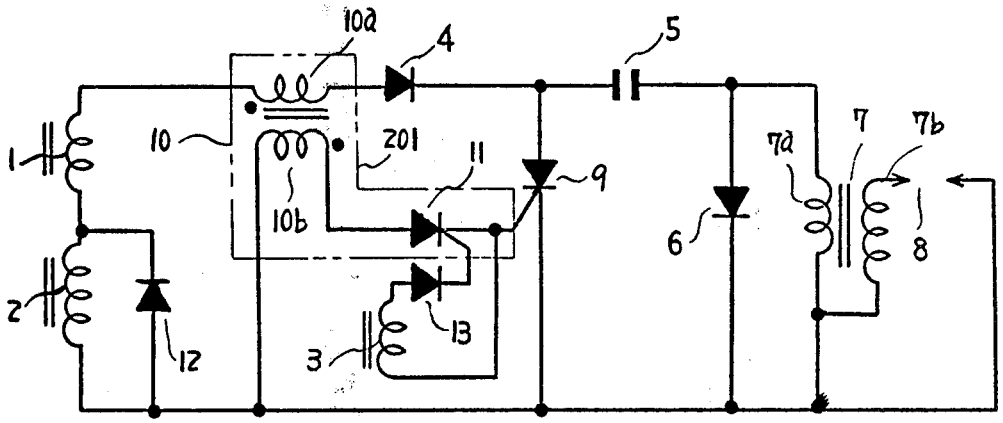

FIG. 15 shows a twelfth embodiment of the present invention, in which the difference with regard to the second embodiment shown in FIG. 4 resides in the thyristor control means 201 in that a transformer 10 is so provided that the primary winding 10*a* thereof is connected in series with the capacitor charging coils 1 and 2 and the secondary winding 10*b* is connected in series with the another thyristor 11. The operation of this embodiment is substantially same as that of the second embodiment shown in FIG. 4.

Figure 16:
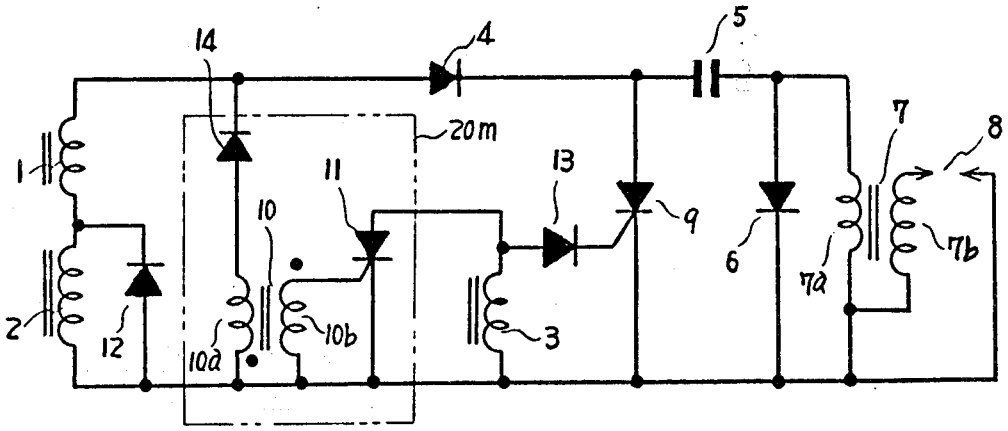

FIG. 16 shows a thirteenth embodiment of the present invention, in which the difference with regard to FIG. 12 resides in the thyristor control means 20*m* which consists of the diode 14, a primary winding 10*a* of a transformer 10 connected in series with each other, and another thyristor 11 connected to the secondary winding 10*b* of the transformer 10. The operation is substantially same as that of FIG. 12.

What I claim is:

1. A capacitor discharge type contactless ignition system for an internal combustion engine comprising:

a capacitor charging coil mounted on a magneto generator driven by an internal combustion engine for generating alternating current in synchronism with the rotation of said internal combustion engine, said alternating current having positive half waves and negative half waves;

a capacitor connected in series with said capacitor charging coil for storing said positive half waves;

an ignition coil having a primary winding and a secondary winding, said primary winding being connected in series with said capacitor;

a spark plug connected to said secondary winding and mounted in said internal combustion engine;

a switching means having a control gate and connected to said capacitor, said switching means, said capacitor and said primary winding forming a capacitor discharging circuit;

a trigger coil for generating first and second signals in synchronism with said internal combustion engine;

a control circuit connected to said trigger coil, said control gate of said switching means and said capacitor charging coil, said control circuit generating ignition signals in response to said first signals and said negative half waves of said alternating current producing during rotation of said engine in a proper direction, said control circuit also generating reversion protecting signals in response to said second signals and the negative half waves of said alternating current produced during rotation of said engine in an improper direction, said ignition signals being supplied to said control gate of said switching means to make it conductive, to thereby discharge the stored charge on said capacitor to produce an ignition spark at said spark plug, to thereby keep the rotation of said engine in said proper direction, said reversion protecting signals being supplied to said control gate of said switching means to discharge the stored charge on said capacitor to produce a spark at a time where the engine is at the position where substantial combustion does not take place, to thereby prevent the reverse rotation from being kept.

2. A capacitor discharge type contactless ignition system as set forth in claim 1, wherein said control circuit comprises:

a transformer having a primary coil and a secondary coil connected to the control gate of said switching means; and a thyristor having a control gate connected to said trigger coil, the anode-cathode path of said thyristor and said primary coil being connected in series with said capacitor charging coil.

3. A capacitor discharge type contactless ignition system as set forth in claim 1, wherein said control circuit comprises:

a PNP transistor connected at its base to said trigger coil, an emitter-collector path thereof being connected across said capacitor charging coil and the emitter thereof being connected to the control gate of said switching means.

4. A capacitor discharge type contactless ignition system as set forth in claim 1, wherein said control circuit comprises:

a thyristor connected across said capacitor charging coil, a gate of said thyristor being connected to said trigger coil and an anode thereof being connected to said control gate of said switching means.

5. A capacitor discharge type contactless ignition system as set forth in claim 1, wherein said control circuit comprises:

a thyristor connected at its anode to said trigger coil and the control gate of said switching means; and a zener diode connected at its cathode to said capacitor charging coil and at its anode to the gate of said thyristor.

6. A capacitor discharge type contactless ignition system as set forth in claim 1, wherein said control circuit comprises:

a thyristor in series connected to said switching means, a gate thereof being connected to said trigger coil; and a diode and a resistor in series connected across said capacitor charging coil, a juncture between said diode and said resistor being connected to said control gate of said switching means.

* * * * *